United States Patent [19]

Arbogast, Jr.

[11] Patent Number: 4,692,121

[45] Date of Patent: Sep. 8, 1987

[54] DUAL SLOT ELECTRICAL CONTACT AND METHOD OF MAKING SAME

[75] Inventor: William C. Arbogast, Jr., Mechanicsburg, Pa.

[73] Assignee: AMP Incorporated, Harrisburg, Pa.

[21] Appl. No.: 882,126

[22] Filed: Jul. 3, 1986

[51] Int. Cl.[4] ..... H01R 4/02

[52] U.S. Cl. ..... 439/874; 29/874; 439/92

[58] Field of Search ..... 339/276 R, 276 ST, 276 SF, 339/277 R, 95 D; 29/861, 874

[56] References Cited

U.S. PATENT DOCUMENTS 3,320,574 5/1967 Tuchel ..... 339/276 R
4,579,404 4/1986 Lockard .
4,602,831 7/1986 Lockard .
4,649,636 3/1987 Arbogast et al. .
4,655,515 4/1987 Hamsher, Jr. et al. .

*Primary Examiner*—Eugene F. Desmond
*Attorney, Agent, or Firm*—Anton P. Ness

[57] ABSTRACT

A contact terminal has a termination section at one end thereof including a spaced pair of axially-extending slots within each of which a respective one of a pair of conductor wires is held in interference fit for weld termination such as by laser welding. The terminal can be a ground terminal for the pair of ground conductors of a tri-lead cable. The terminal is stamped from a metal blank and its termination section is formed by bending upwardly side portions thereof to create parallel vertical side walls, and bending back along the termination section a tab portion of selected width having parallel vertical side surfaces. The slots are defined by the side surfaces of the bent back tab portion and the respective side walls.

12 Claims, 9 Drawing Figures

Fig. 4C
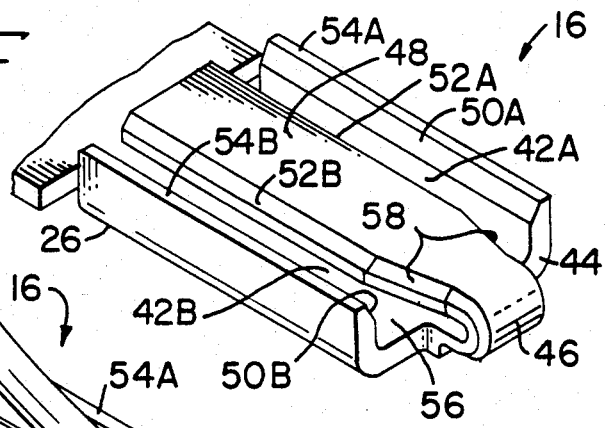
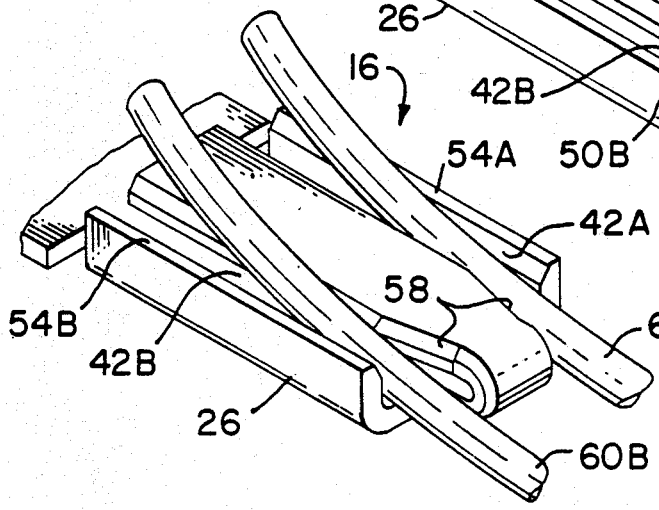
Fig. 5A
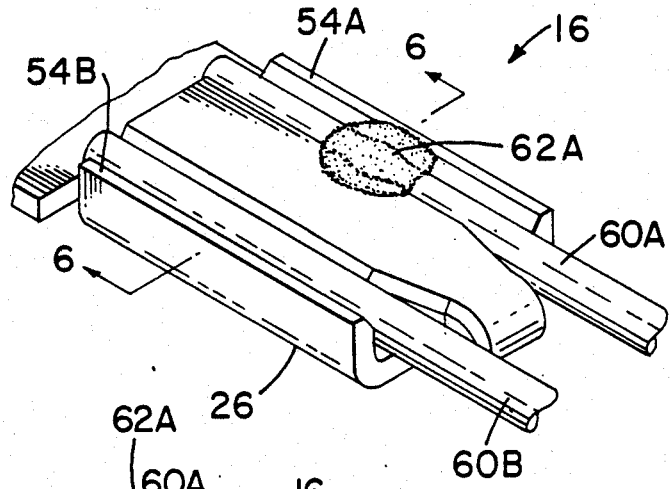
Fig. 5B
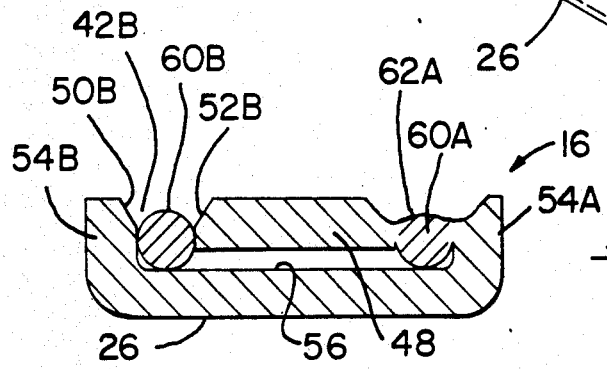
Fig. 6

DUAL SLOT ELECTRICAL CONTACT AND METHOD OF MAKING SAME

FIELD OF THE INVENTION

This relates to the field of electrical connectors and more particularly to contact terminals for conductor termination.

BACKGROUND OF THE INVENTION

Electrical contact terminals are known which are used to terminate a pair of conductors in a single slot by welding, particularly by laser welding. Such contact terminals are known from U.S. Pat. No. 4,579,404 for use in a single-row electrical connector for terminating the pairs of ground conductors in tri-lead high speed signal transmission cables. A similar but double row connector is known from U.S. patent application Ser. No. 754,785 filed July 12, 1985 and assigned to the assignee hereof. Such terminals require the pairs of ground conductors to be brought together side-by-side near the top of the slot and in interference fit therein for termination remote from the respective signal conductors of the cables. The signal conductors are separately but similarly terminated to respective signal terminals insulated from the ground terminals by the dielectric carrier to which the terminals are secured, and the entire conductor-terminated subassembly is then overmolded forming the connector. Contact sections of the terminals are disposed at the forward end of the connector, ready for electrical engagement with corresponding terminal means of a mating electrical connection means.

When the side-by-side conductors are laser welded, the area of the weld joint of course is wider than if a single conductor were being welded in a correspondingly narrower slot. In both cases the weld joint must join to the sidewalls of the slot whose top surfaces are preferably approximately coplanar with the top portions of the conductor or conductors for optimizing the laser weld termination. However, a typical conductor diameter is about 0.010 inches and the corresponding weld joint for the side-by-side conductors is about 0.040 to 0.045 inches in diameter. A smaller weld joint for only one such conductor requires less energy of the laser beam during welding and a lower energy level incurs less risk of damaging the very small conductor wire.

From U.S. Pat. Nos. 4,602,831 (for a single-row connector) and 4,655,515 (for a double-row connector), both assigned to the assignee hereof, it is known to place individual signal terminals along one side of a dielectric contact carrier, and a single ground plane on the other side of the carrier. In U.S. Pat. No. 4,602,831 all ground conductors of the single row of tri-lead cables (or a tri-lead flat cable) are terminated to the ground plane, single in respective single width slots by welding such as laser welding. In U.S. Pat. No. 4,655,515 each row of cables (or each flat cable) has a contact carrier associated with it having signal terminals on one side and a single ground plane on the other, with each slot of the ground plane receiving a pair of side-by-side ground conductors therein for laser weld termination. Either ground plane is formed by first stamping the plurality of slots in a metal blank near one side edge of the blank, then folding over a portion of the blank along that side edge so that the slots now extend out to the newly formed edge to receive the conductor or pair of conductors. But with either ground plane all grounds of a row of cables (or of the flat cable) are terminated only on the same side of the carrier, and each row of cables or flat cable requires its own contact carrier. Thus, either type of ground plane delimits or complicates the programmability of a double-row connector, and cannot be used in the double-row connector of aforementioned Ser. No. 754,785.

It is desired to provide a contact for two conductor wires which includes a separate slot for each conductor, each for receiving a respective one of the conductors for individual weld termination, as disclosed in U.S. patent application Ser. No. 882,048 filed July 3, 1986 (concurrently herewith) and assigned to the assignee hereof.

SUMMARY OF THE INVENTION

A stamped and formed contact terminal with a contact section proximate one end thereof, has a spaced pair of parallel slots extending inwardly from the other end thereof to receive respective conductors thereinto to be held in interference fit therein for weld termination such as by laser welding. Each slot has at least at one axial location therealong a width slightly less than the diameter of the conductor and holds its conductor so that the top most portion of its conductor is approximately coplanar with the top of at least one side of the slot.

The dual slot terminal of the present invention is made by stamping a terminal blank including a contact section and a tab portion extending rearwardly from a termination section, joined thereto by a narrower neck portion and having a precisely selected width. Side portions of the termination section are bent upward forming low height vertical sidewalls, and the tab portion is bent backward at the neck portion to be disposed between the side walls and along the termination section, spaced from the side walls to define a pair of slots of precise width. The top of the bent over tab portion is preferably coplanar with the top surfaces of the side walls, and edges along the slots are preferably swaged.

It is an objective of the present invention to provide a dual slot terminal and a method for making such a terminal with slots of precisely controlled width for holding respective conductors in interference fit therein for laser weld termination.

BRIEF DESCRIPTION OF THE DRAWINGS

FIGS. 4A to 4C illustrate the forming of the termination section of the dual slot terminal of the invention.

FIGS. 5A and 5B illustrate the placement of conductors in the slots of the terminal and weld termination of one of them.

FIG. 6 is a cross-sectional view taken along lines 6—6 of FIG. 5B and showing the laser weld termination joint of one of the conductors.

DETAILED DESCRIPTION OF THE PREFERRED EMBODIMENT

Figure 1:
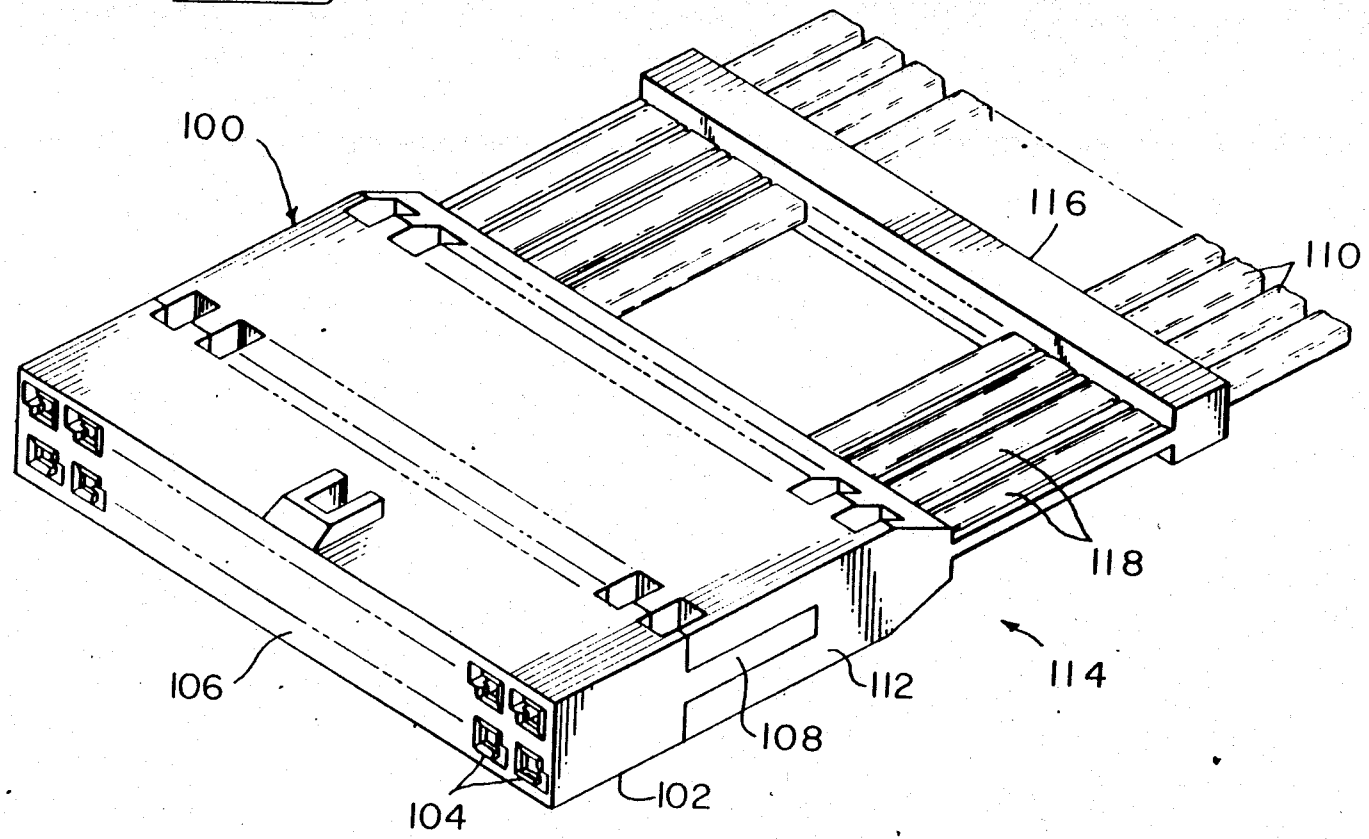
FIG. 1 is a double-row connector for signal transmission cable in which the present invention may be used.

In FIG. 1 is shown an electrical connector such as that of U.S. Ser. No. 754,785. Connector 100 comprises a terminal assembly 102 having a plurality of terminals disposed in passageways 104 extending rearwardly from the mating face 106 of the connector. Rearward sections of the terminals (not shown) extend along a contact-carrying portion 108 of the terminal assembly and are terminated to conductors of cables 110. A dielectric covering 112 is overmolded over the terminal assembly sealing the terminations and extending along cables 110 securing the cables to the connector to form a cable harness 114 and provide nondistorting strain relief. Also seen is a transverse bar 116 spaced rearwardly from covering 112 and joined to it by axial webs 118, bar 116 also being molded over the cables integrally with covering 112 and providing secondary nondistorting strain relief for the cables and also spacing and supporting them.

Figure 2:
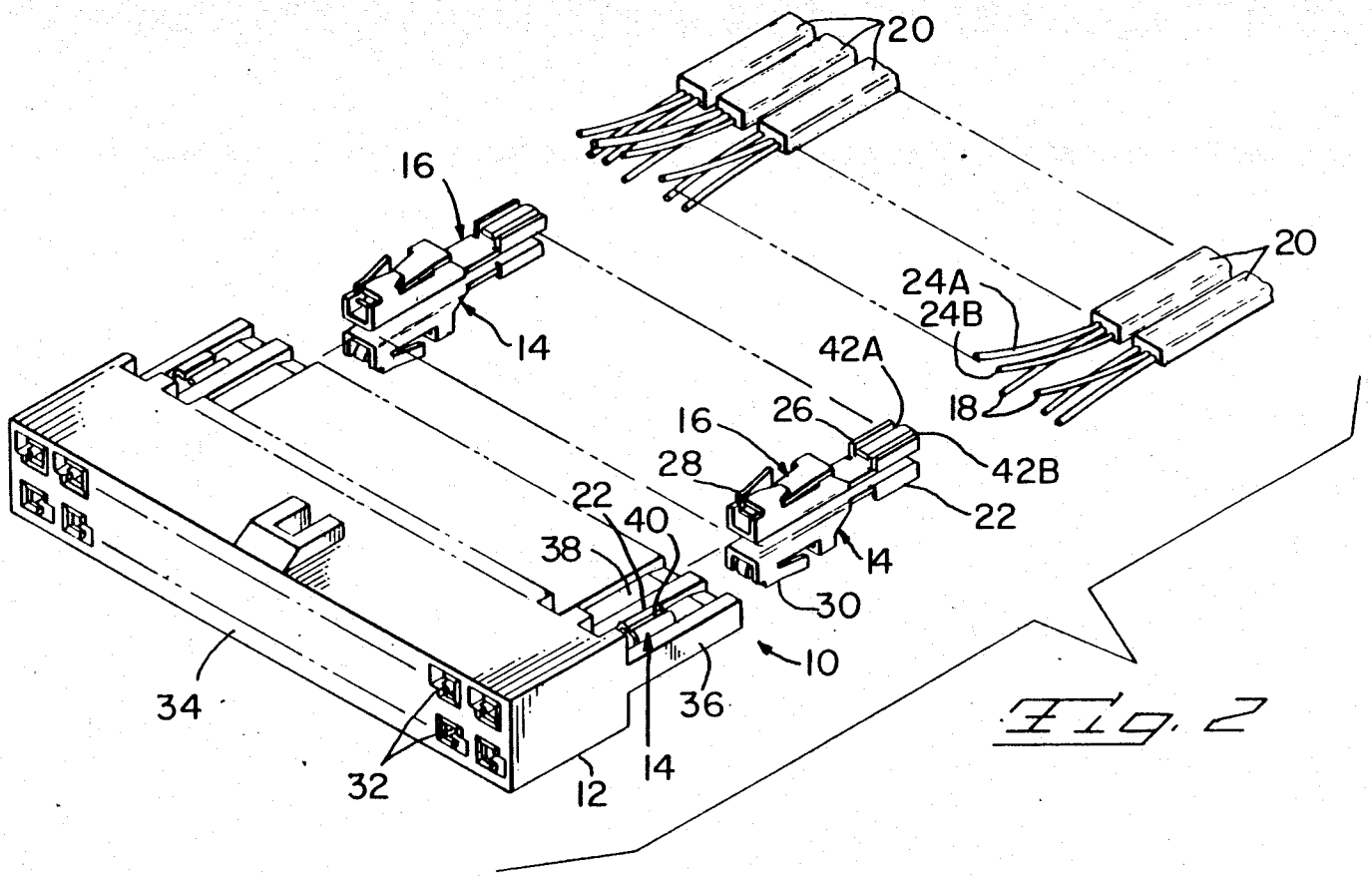
FIG. 2 is an exploded view of a terminal assembly usable with the electrical connector of FIG. 1, using the dual slot terminal of the present invention.

FIG. 2 shows a terminal assembly 10 usable in such a connector, which assembly comprises a premolded forward housing member 12, signal terminals 14 and ground terminals 16. Signal conductors 18 of cables 20 are stripped to be terminated to termination sections 22 of signal terminals 14, and pairs of ground conductors 24A,24B of cables 20 and stripped to be terminated to termination sections 26 of ground terminals 16. Contact sections 28 of ground terminals 16 are identical to contact sections 30 of signal terminals 14 and will be disposed along and secured within passageways 32 of housing 12 which extend from housing mating face 34 to contact-carrying portion 36. Termination sections 22,26 of signal and ground terminals 14,16 extend along contact-carrying portion 36, preferably in shallow recesses 38 thereof. Terminal assembly 10 is assembled by securing contact sections 28,30 of terminals 14,16 within passageways 32 of housing 12, then terminating conductors 18,24A,24B to appropriate ones of terminals 14,16, and thereafter molding a dielectric covering over the contact-carrying portion, the terminals and stripped conductors, and along end lengths of the cables. During overmolding, rear ends of passageways 32 are closed off by core pins in the mold which also hold terminals 14,16 firmly against the respective top or bottom surface of contact-carrying portion 36 of housing 12.

Each signal terminal 14 preferably includes a single conductor-receiving slot 40 which is of a width just less than the diameter of a corresponding signal conductor 18. Signal conductor 18 is then wiped carefully along and into slot 40 by appropriate apparatus such as that disclosed in U.S. Pat. No. 4,649,636 assigned to the assignee hereof. Signal conductor 18 will be held by interference fit within slot 40 until being welded therein such as preferably by laser welding.

Figure 3:
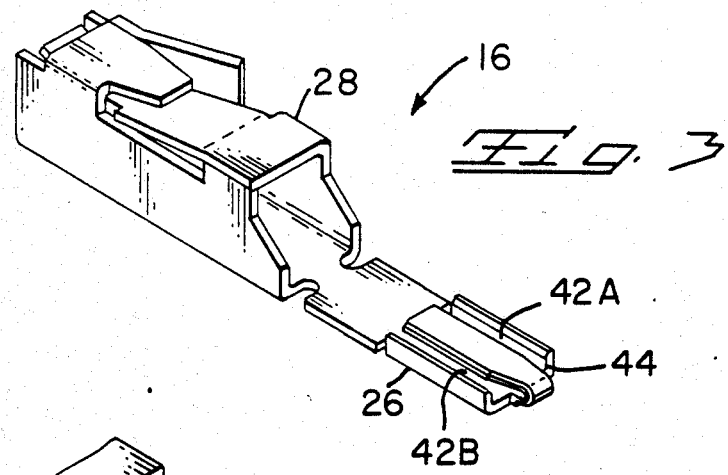
FIG. 3 is an enlarged view of the embodiment of the dual slot terminal of FIG. 2.

Each ground terminal 16, best seen in FIG. 3, includes a spaced pair of parallel conductor-receiving slots 42A,42B extending forwardly from a rearward end 44 of terminal 16. Within each slot 42A,42B will be wiped a respective ground conductor 24A,24B as with signal conductor 18 in slot 40 of signal terminal 14 above. Best seen in FIGS. 5A,5B and 6, slots 42A,42B are slightly less wide than the diameter of respective ground conductors 24A,24B, to hold them in interference fit therein until being welded therein such as preferably by laser welding. Slots 42A,42B preferably have lead-ins to assist in receiving a respective conductor being wiped thereinto and minimize possible damage to the conductor wire which may typically have a diameter of about 0.010 inches.

Figure 4A:
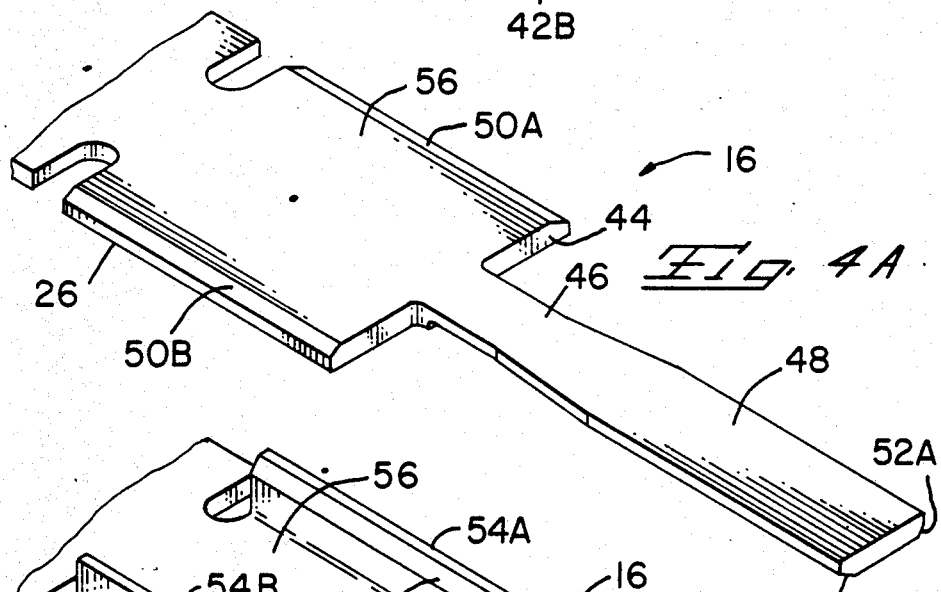
Figure 4B:
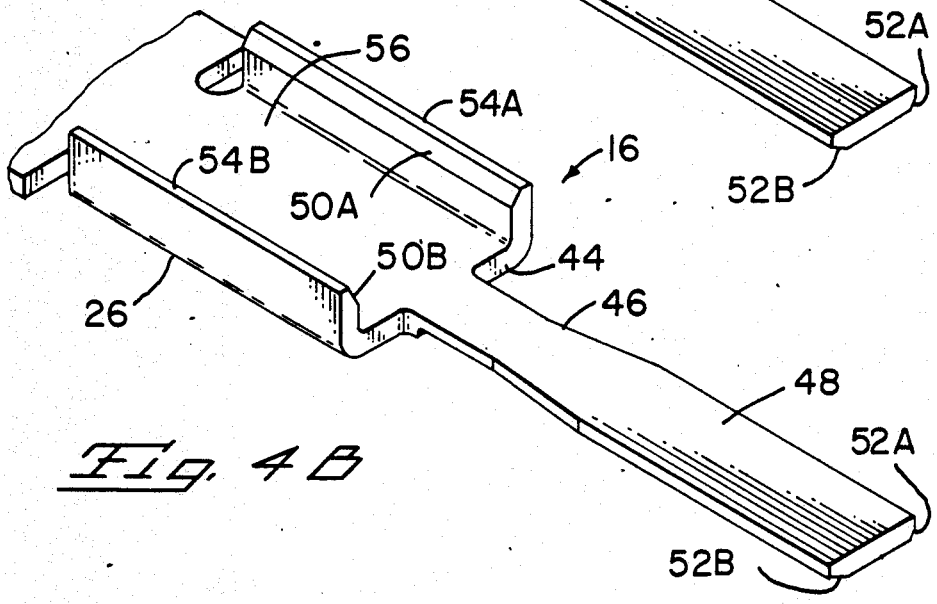

As shown in FIGS. 4A to 4C, terminal 16 is stamped from a sheet of metal such as phosphor-bronze alloy, Copper Alloy 511 having a thickness of for example 0.007 inches. The contact section may be of the receptacle type 28 shown in FIG. 3. Prior to forming it is preferred to swage top side edges 50A,50B of termination section 26 and bottom side edges 52A,52B of tab portion 48. It may be advantageous to reduce the thickness of the metal blank at neck portion 46 to facilitate bending. In FIG. 4B side portions of termination section 26 are bent upward to form side walls 54A,54B, and in FIG. 4C tab portion 48 is bent up and then back along surface 56 of termination section 26, forming two slots 42A,42B in termination section 26. Swaged edges 50A,50B and 52A,52B are disposed along tops of slots 42A,42B and will cooperate to form axially extending lead-ins to receive respective conductors being wiped thereinto, while neck portion 46 being narrower than tab portion 48 and also tapered now defines initial lead-ins 58 at the cable-proximate end 44 of termination section 26. In FIGS. 5A and 5B stripped conductors 60A,60B are shown first partially wiped into interference fit within respective slots 42A,42B, and then fully wiped thereinto. Conductor 60A is terminated by weld joint 62A which is preferably a laser weld joint. FIG. 6 illustrates conductors 60A,60B in interference fit between sides of tab portion 48 and respective opposing sidewalls 54A,54B and showing weld joint 62A.

The dual slot terminal of the present invention can be made with minor variations without departing from the spirit of the invention and the scope of the claims. Such a terminal would most commonly be used as a ground terminal for a tri-lead cable to receive a pair of ground wires associated with the same signal conductor. But the terminal can be used to recieve ground conductors from two cables, or even signal conductors from two different cables were it be desired for the terminal to conduct an electrical signal from either one of a pair of cables.

What is claimed is:

1. An electrical connection of a contact terminal and two conductor wires, comprising:

two conductor wires having selected diameters and being exposed for terminating; and a contact terminal including a termination section having a spaced pair of conductor-receiving slots extending forwardly from a rearward end thereof, said slots defined by a central portion of said termination section bent back from a rearward end thereof having a selected width and parallel, vertical side edge surfaces, and parallel side walls of said termination section bent vertically upwardly from side portions thereof and spaced from respective said side edge surfaces of said central portion a selected distance at at least one axial location defining a slot width thereat selected to be just less than the diameter of a respective said conductor wire to hold a said wire in interference fit therein and terminated thereto by a weld joint.

2. An electrical connection as set forth in claim 1 wherein said weld joint is a laser weld joint.

3. An electrical connection as set forth in claim 1 wherein said two conductor wires are ground conductor wires associated with the same signal conductor wire of a tri-lead cable means.

4. A contact terminal for terminating two small diameter conductor wires without substantially distorting the conductor wires comprising a member stamped from a metal blank and formed to have a forward contact section and a rearward termination section, said rearward termination section initially comprising a planar blank portion having a central section, side portions along said central section, and a tab portion of selected width extending rearwardly from a neck portion joined to a rearward end of said central section, and said rearward termination section finally including a spaced pair of conductor-receiving slots extending forwardly from said rearward end of said central section, said slots having outer walls defined by top surface portions of said side portions after said side portions are bent upwardly to be vertically upstanding a selected distance apart, whereafter said top surface portions face inwardly and said slots having inner walls defined by parallel vertical side edge surfaces of said tab portion bent back at said neck portion and along a top surface of said central section and centered between said upstanding side portions, said width of said tab portion and said distance between said upstanding side portions being selected such that each said slot has a width at least at one axial location just less than the diameter of a respective said conductor wire whereby each said slot is adapted to hold a said wire in interference fit therein to be terminated by welding, and the top surface of said bent back tab portion being disposed a distance above said central section approximately equal to said diameter of a respective said conductor wire defining a slot depth whereby each said slot is so adapted that upon insertion of a said conductor wire into and along a respective said slot, top portions of said conductor wires are approximately coplanar with said top surface of said bent back tab portion to facilitate weld termination.

5. A contact terminal as set forth in claim 4 wherein said top surface of said bent back tab portion and top surfaces of said upstanding side portions are substantially coplanar.

6. A contact terminal as set forth in claim 4 wherein the edges at the tops of said slots are swaged to define lead-ins for wiping thereinto respective said conductor wires.

7. A contact terminal as set forth in claim 6 wherein said bent back tab portion has tapered side surface portions proximate said neck portion, defining initial lead-in means for wiping a said conductor wire thereinto.

8. A method of making a dual slot contact terminal for terminating two conductor wires, comprising the steps of:

stamping a terminal blank from sheet metal having a contact section at a forward end thereof and a termination section at a rearward end thereof, said termination section including a tab portion extending rearwardly therefrom and joined thereto by a neck portion, said tab portion having a selected width and parallel vertical side edge surfaces, and said termination section further including side portions therealong;

forming a tab-receiving channel along said termination section by bending said side portions vertically upwardly into parallel side walls a distance apart selected in relationship to said tab portion width so that inner surfaces of said parallel side walls at least at one axial location therealong exceed said tab portion width by a distance just less than the sum of the diameters of said two conductor wires; and bending said tab portion back along said termination section centered between said side walls such that said side edge surfaces are spaced selected distances from said side walls, defining parallel slots each having a width at least at one axial location therealong selected to be just less than the diameter of a respective conductor wire to hold a said wire in interference fit therein to be terminated thereto by welding, and such that the top surface of said bent back tab portion is disposed a distance above said termination section approximately equal to the diameter of a respective said conductor wire whereby a slot depth is defined so that upon insertion of a said conductor wire into and along a respective said slot, top portions of said conductor wires are approximately coplanar with said top surface of said bent back tab portion to facilitate weld termination of said conductor wires to said contact terminal.

9. A method as set forth in claim 8 wherein said termination section of said terminal blank is stamped to have a width selected such that said side portions thereof after being bent vertically upwardly form side walls each having a respective height so that top surfaces of said formed side walls are approximately coplanar with said top surface of said bent back tab portion to facilitate weld termination of said conductor wires to said contact terminal.

10. A method as set forth in claim 9 further including the steps, prior to said forming and tab bending steps, of swaging top side edges of said side portions of said termination section and bottom side edges of said tab portion, whereby an axially extending lead-in is defined by said swaged edges along the tops of said slots after said forming and tab bending steps.

11. A method as set forth in claim 8 wherein said stamping step includes stamping a slightly outwardly tapered portion between said neck portion and said tab portion, whereby after said tab bending step said tapered portion defines initial lead-in means for respective said slots at the rearward end of said termination section.

12. A method as set forth in claim 8 further including the step of forming said contact section of said terminal blank into a means for electrically engaging a mating electrical terminal means.

* * * * *